United States Patent [19]

Strobel et al.

[11] 3,959,752

[45] May 25, 1976

[54] NARROW MULTI-POLE CIRCUIT BREAKER HAVING BODILY MOVABLE INSTANTANEOUS TRIP STRUCTURE

[75] Inventors: Albert Strobel, Cherry Hill, N.J.; Charles T. Robins, Swarthmore, Pa.

[73] Assignee: I-T-E Imperial Corporation, Spring House, Pa.

[22] Filed: Mar. 4, 1975

[21] Appl. No.: 555,164

[52] U.S. Cl. ..... 335/10; 335/38; 335/174

[51] Int. Cl.[2] ..... H01H 75/100; H01H 77/100

[58] Field of Search ..... 335/8, 10, 21, 22, 23, 335/35, 38, 174; 337/52, 70, 97; 317/18 R

[56] References Cited

UNITED STATES PATENTS

| | | | |
|---|---|---|---|
| 2,703,351 | 3/1955 | Hulbert | 337/50 |
| 3,147,353 | 9/1964 | Leonard | 337/70 X |
| 3,204,063 | 8/1965 | Nash et al. | 337/50 |
| 3,288,965 | 11/1966 | Klein | 337/70 |
| 3,401,363 | 9/1968 | Vyskocil et al. | 335/23 |
| 3,908,154 | 9/1975 | Gryctko | 317/18 R |

FOREIGN PATENTS OR APPLICATIONS

| | | | |
|---|---|---|---|
| 812,322 | 5/1969 | Canada | 335/10 |

*Primary Examiner*—J. D. Miller
*Assistant Examiner*—Fred E. Bell
*Attorney, Agent, or Firm*—Ostrolenk, Faber, Gerb & Soffen

[57] ABSTRACT

A plurality of single pole circuit breakers stacked side-by-side are interconnected by a tie rod connecting the magnetic armatures of their respective instantaneous trip means. When one pole is caused to trip because of a fault condition a driving cam formation on the releasable cradle of the faulted pole engages the armature moving it in the tripping direction substantially beyond the point required for releasing the cradle latch in the faulted phase. Substantial movement beyond cradle release is permitted even though the magnetic air gap at the armature is small in that after this gap is closed the magnet is moved bodily in the tripping direction. This added movement assures that the tie rod shall transmit sufficient motion to all non-faulted poles to cause tripping thereof.

5 Claims, 4 Drawing Figures

NARROW MULTI-POLE CIRCUIT BREAKER HAVING BODILY MOVABLE INSTANTANEOUS TRIP STRUCTURE

This invention relates to multipole circuit breakers in general and more particularly relates to a circuit breaker of this type constructed to assure that fault current tripping of one phase will cause tripping of non-faulted phases. Relatively low current multipole molded case circuit breakers are often constructed by assembling a plurality of single pole units side-by-side and mechanically interconnecting their trip units by means of a tie bar. Opening of one pole because of a fault current condition will cause trip units in the other poles to be actuated. Molded case circuit breakers having a continuous rating of between 10 and 20 amperes are often constructed so that their housings are ½inch wide. A construction of this type is illustrated in U.S. Pat. No. 3,147,353, issued Sept. 1, 1964, to J. H. Leonard for a Contact Weld Breaking Means. Because this type of circuit breaker pole unit is so thin, the electrical and mechanical operating elements are extremely crowded and as a result only slight movements of the automatic trip elements can be achieved.

Coupling the relatively small movements of the trip elements with parts tolerances and possible misalignment of elements results in a substantial problem when a plurality of pole units are assembled as a multi-pole device. That is, in a multi-pole device of this type, the basic compact design, tolerances and misalignments may combine adversely so that tripping of one pole will not result in sufficient movement in the other poles to cause tripping thereof.

In accordance with the instant invention, the inter-pole tie between automatic trip units is achieved by a rod connected directly to the movable armature of the magnetic trip means. The releasable cradle of the contact operating mechanism is provided with a cam means operatively positioned for engagement with the magnet trip armature when automatic tripping occurs.

Actuation of the magnetic trip means in a faulted pole requires only slight movement of the armature in this pole, and this slight movement may not bring about sufficient movement of the armature in a non-faulted pole to cause cradle release therein. However, in accordance with the instant invention the magnet is mounted for bodily movement. Thus, in a faulted phase where the thermal trip has been actuated, as the cradle cam drives the armature in the tripping direction beyond the point required for latch release there is added movement permitted in that the armature is forced against the magnet and the latter yields. This added motion of the armature past the minimum latch release position assures that there will be sufficient motion transmitted to the armatures of all non-faulted poles to cause tripping thereof.

Accordingly, a primary object of the instant invention is to provide a novel compact multi-pole molded case circuit breaker in which there is an inter-pole trip means constructed so as to assure tripping of all non-faulted poles upon automatic tripping of a single pole.

Another object is to provide a circuit breaker of this type in which each pole unit is constructed so that upon automatic tripping the armature will move considerably past the minimum position required for release of a latchable cradle of the contact operating mechanism.

Still another object is to provide a circuit breaker of this type in which the magnetic structure is constructed and mounted to permit movement of the armature in the tripping direction for a distance substantially greater than the armature air gap, thereby assuring that armatures in the other poles will move sufficiently to cause release of their respective mechanism latches.

These objects as well as other objects of this invention shall become readily apparent after reading the following description of the accompanying drawings in which:

In FIG. 3 the contacts are closed, in FIG. 4 the contacts are in tripped open position.

Figure 1:
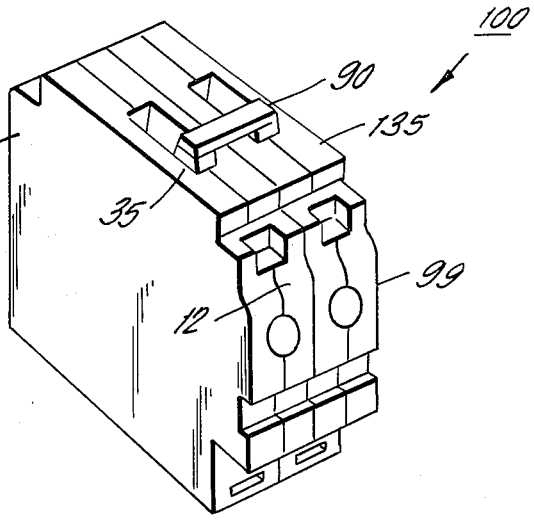
FIG. 1 is a perspective of a two-pole molded case circuit breaker constructed in accordance with teachings of the instant invention.

Now referring to the figures. Two-pole circuit breaker 100 is adapted to be mounted in a panelboard of the type illustrated in U.S. Pat. No. 3,767,977 issued Oct. 23, 1973, to A. Bachman for an Electric Distribution Panel Having Extruded Buses and Contact Stabs. Circuit breaker 100 is constructed of substantially identical half-inch wide molded case circuit breaker pole units 10, 99 stacked in abutting side-by-side relationship. Operating handles 35, 135 are connected by handle tie 98. As will be hereinafter explained, tie rod 97 extends through housing apertures (not shown) and interconnects the instantaneous trip devices of both pole units 10 and 99.

Circuit breaker pole unit 10 is generally of the type described in detail in U.S. Pat. No. 3,147,353 issued Sept. 1, 1964, to J. H. Leonard for a Contact Weld Breaking Means. The load current path (indicated by heavy broken line 88 in FIG. 3) through circuit breaker 10 consists of line terminal 11 at the left end of molded housing part 12, stationary contact 14, movable contact 15 at the lower end of movable contact arm 16 pivoted at its upper end 17 against latchable cradle 18, through a section of cradle 18, through bimetal strip 20, flexible braid 21 and load terminal extension 22 to load terminal 23 connected to wire grip 24 located at the right side of housing part 12 near the upper end thereof.

Releasable cradle 18 is normally maintained in its latched or reset position by intermediate latch 25 pivotally mounted to cradle 18 on insulating pin 19, with insulating sheet 26 being interposed between intermediate latch 25 and cradle 18. Conducting leaf spring element 34 secures pin 19 to cradle 18. Intermediate latch 25 engages the in-turned free end 27 of bimetal 20 and also engages latch surface 28 formed by the generally square folded-over out-turned free end portion 95 of modified U-shaped spring 29 welded to tripping armature 31 and biasing the latter away from U-shaped magnetic yoke 32. The latter surrounds load terminal extension 22 which acts as an energizing turn for magnet 31, 32. For a reason to be hereinafter explained, leg 90 of spring 29 biases yoke 32 toward intermediate latch 25 with this movement being limited by a formation in housing part 12. Main operating spring 33 is a tension member connected at its lower end 36 to contact arm 16 and at its upper end 37 to downward extension 38 of manual operating handle 35 whose arcuate lower section 39 is journalled for movement within arcuate slot 41 of housing part 12.

Tie rod 97 extends though the openings in free end portion 95 to spring 29 in each pole unit 10, 99 to mechanically connect movable magnetic armatures 31 of both pole units 10, 99.

Figure 2:
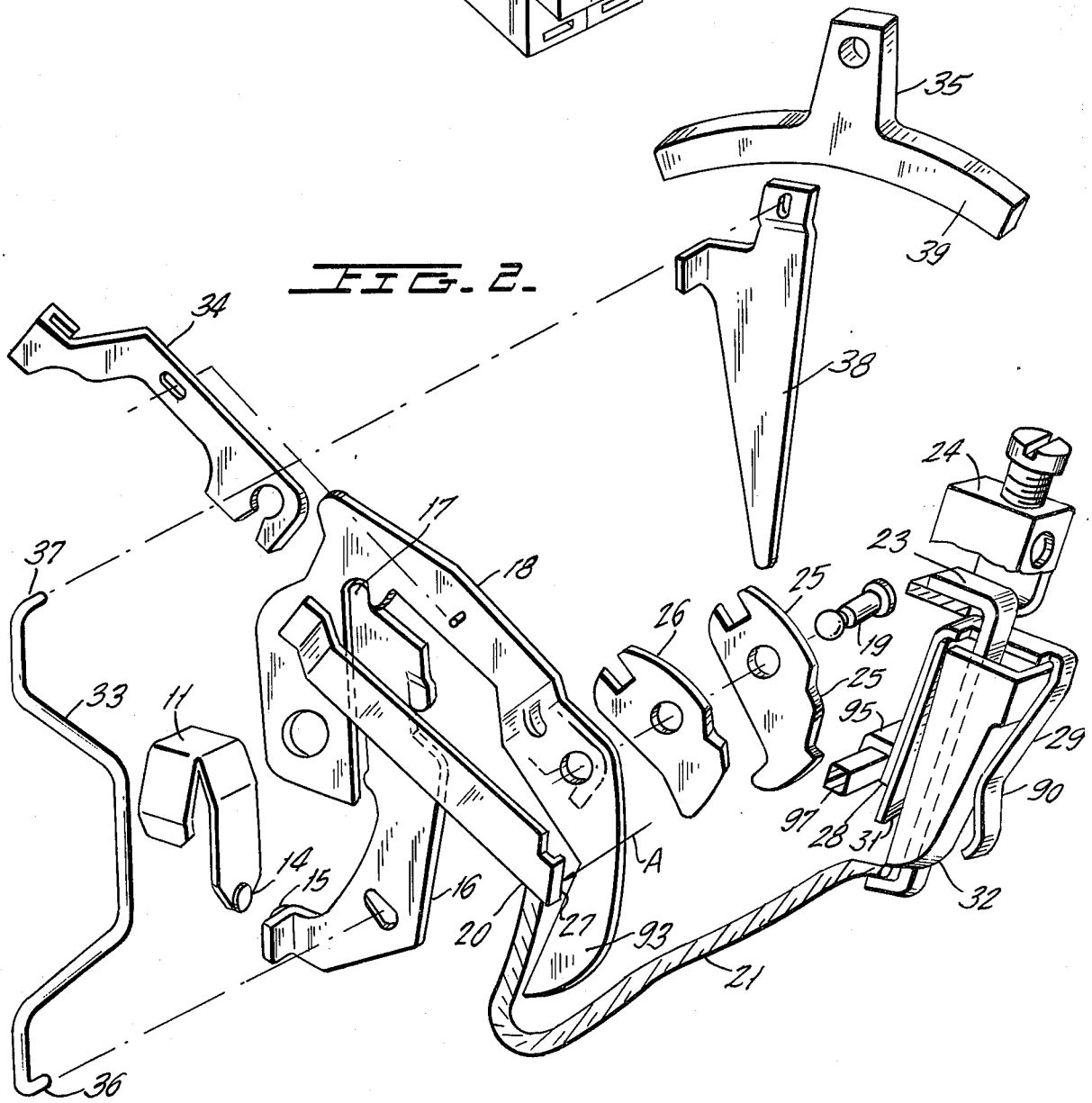
FIG. 2 is an exploded perspective showing the major current carrying and contact operating elements of one pole unit of the circuit breaker of FIG. 1.

Under moderate overload conditions current carried by circuit breaker 10 flows through bimetal strip 20, to heat the latter. This heating causes the free latching end 27 of bimetal 20 to deflect outward, or in the direction of arrow A in FIG. 2, until latching tip 27 clears intermediate latch 25. At this point the upward force exerted by main spring 33 on cradle 18 and the elements mounted thereto causes intermediate latch 25 to pivot clockwise and clear latch surface 28 so that cradle 18 is unlatched and pivots counterclockwise about case pivot 94 until pivot point 17 at the upper end of contact arm 16 moves to the left of the line of action for main spring 33. When this occurs, main spring 33 pulls contact arm 16 to the right, causing movable contact 15 to separate from stationary contact 14, to bring about opening of circuit breaker 10.

Release of cradle 18 causes cam extension 93, disposed thereon in the vicinity of auxiliary latch 25, to engage square formation 95 of spring 29. Thus, engagement of elements 93 and 95 moves armature 31 toward magnet 32 through a distance substantially greater than the minimum distance required for latching surface 28 to move in order to release auxiliary latch 25 during the occurence of severe overloads which cause magnetic tripping. This minimum tripping distance is only slightly less than the distance of the magnet air gap at the lower end of armature 31.

Sufficient movement of armature 31 in the tripping direction is assured because of the resilient mounting for yoke 32. That is, when cradle 18 is released cam 93 drives armature 31 in the tripping direction. After the magnet air gap closes armature 31 engages yoke 32 and as armature 31 continues to be moved in the tripping direction yoke 32 also moves in this direction as spring portion 90 is straightened from its normally bowed condition. Thus, armature 31 moves in the trippng direction considerably past the position required for minimal motion of latching surface 28 to release cradle 18. This added motion of armature 31 in the faulted pole assures that sufficient motion is transmitted through tie rod 97 to cause tripping of the non-faulted pole.

Figure 3:
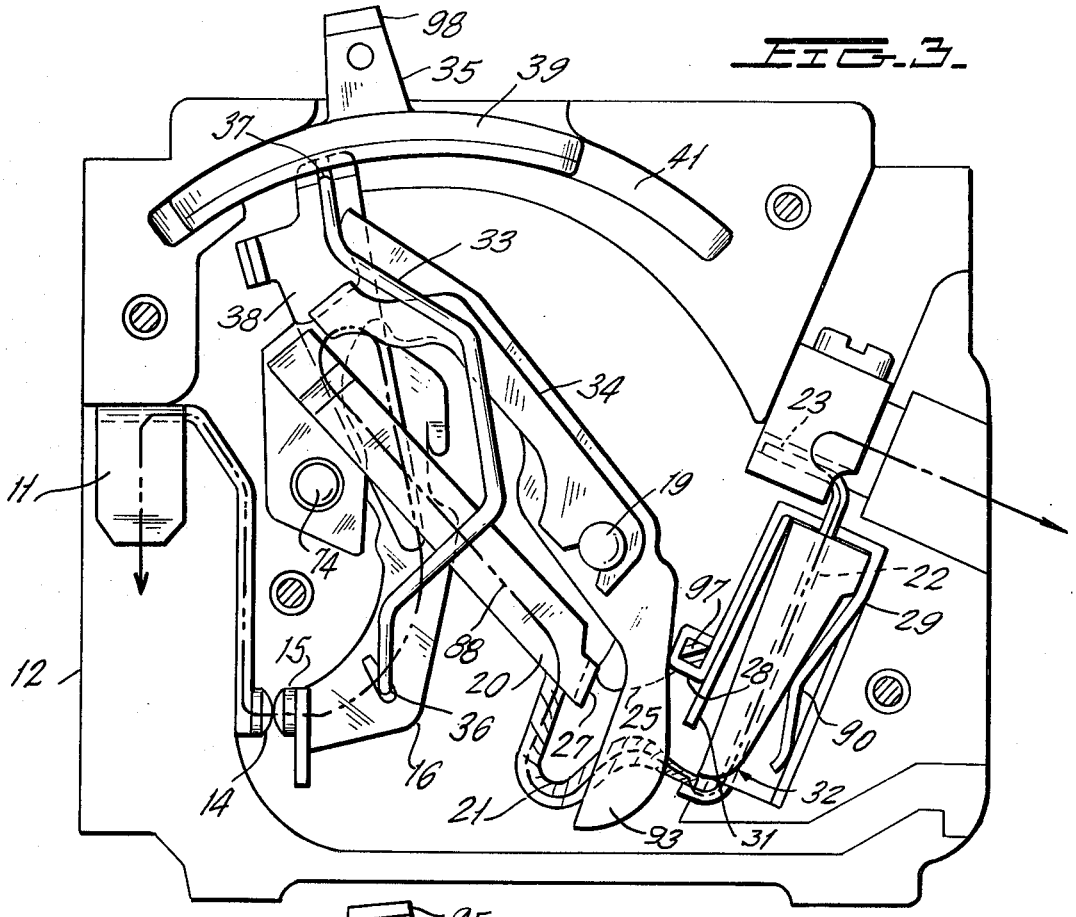
FIGS. 3 and 4 are side elevations of one pole unit of the circuit breaker of FIG. 1, with the near housing wall removed to reveal the operating elements.
Figure 4:
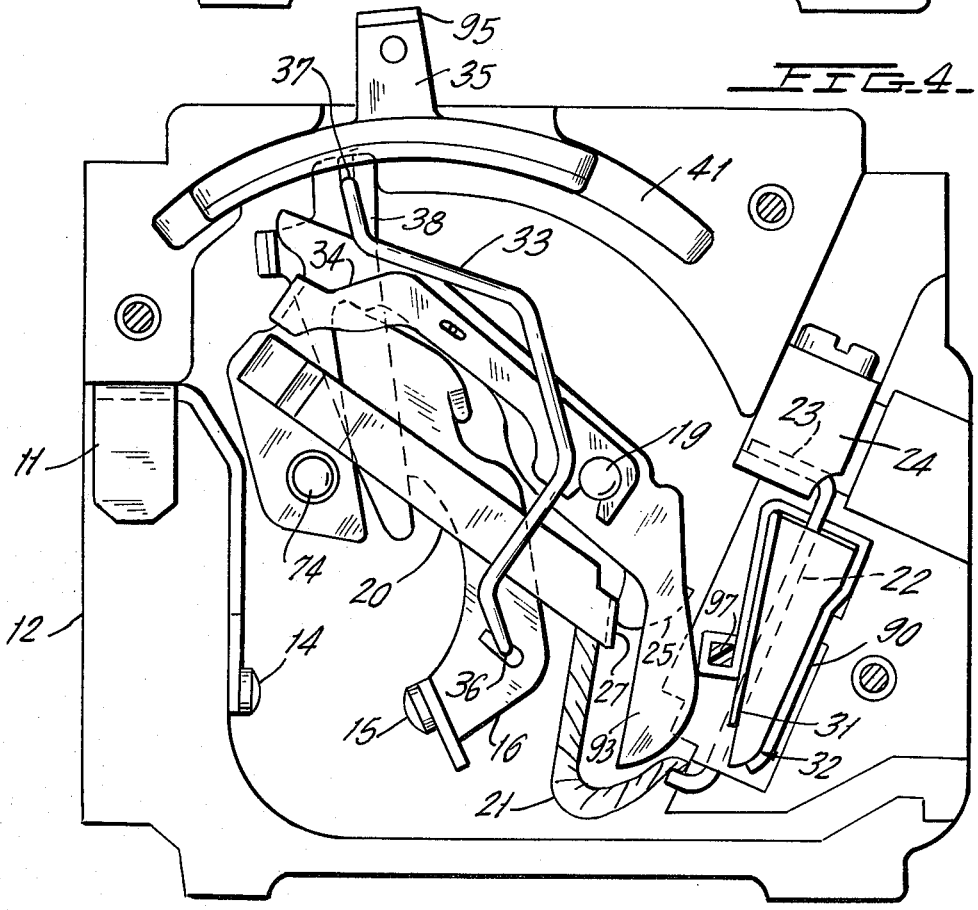

Under severe overload conditions armature 31 is attracted to magnet 32 to close the magnetic air gap, thereby moving latching surface 28 to the right with respect to FIG. 3 until portion 95 moves to the right of auxiliary latch 25 at which time cradle 18 is free to pivot counterclockwise about pivot formation 94 to bring about separation of cooperating contacts 14, 15. Additional motion in the tripping direction is then imparted to armature 31 as a result of cradle cam 93 engaging formation 95 driving armature 31 and yoke 32, as a unit, in the tripping direction in the manner previously explained.

While this invention is illustrated in the drawings as consisting of circuit breaker pole units stacked adjacent to each other, the invention is not so limited but is broad enough to include an arrangement in which there is a considerable space between pole units as in copending U.S. Pat. application Ser. No. 505,682 filed Sept. 13, 1974, by C. E. Gryctko et al. for a Two Pole Ground Fault Circuit Protector, and assigned to the assignee of the instant invention.

Although in the foregoing preferred embodiments have been discussed, many variations and modifications will now become apparent to those skilled in the art and it is therefore understood that this invention is not limited by the disclosure but only by the appending claims.

The embodiments of the invention in which an exclusive privilege or property is claimed are defined as follows:

1. A circuit breaker having a plurality of poles and including, for each pole thereof, cooperating contact means, releasable operating means for opening and closing said contact means, latch means for maintaining said operating means in operative condition to close said contact means, and fault current responsive trip means which when actuated trips said latch means to release said operating means which renders the latter inoperative to close or maintain said contact means closed; said trip means including an electromagnet comprising a relatively stationary magnetic frame and a magnetic armature movable from a normal forward position rearward through a latch releasing position upon predetermined energization of said electromagnet, tie means interconnecting said armatures of said plurality of poles for simultaneous operation thereof; biasing means for said armature urging the latter toward said normal position; within a pole carrying fault current said armature being moved rearward magnetically to said latch releasing position after which said armature is moved further to the rear through operative engagement thereof by said operating means with this further movement to the rear assuring that armatures in all remaining poles will be moved rearward by said tie means at least to their latch releasing positions.

2. A circuit breaker as set forth in claim 1 in which there is a biasing means urging said frame forward to a normal position, said frame being mounted for limited movement to the rear of said normal position by means of force applied thereto by said operating means acting through said armature.

3. A circuit breaker as set forth in claim 2 in which said frame remains in its said normal position until after said armature is to the rear of said latch releasing position.

4. A circuit breaker as set forth in claim 3 in which movement of said armature to the rear of said latch releasing position results from operative engagement of said armature by a cam formation on a releasable cradle of said operating means.

5. A circuit breaker as set forth in claim 4 in which the cam formation is operatively engageable with said armature in the region of said tie means.

* * * * *